United States Patent [19]

Solum

[11] Patent Number: 4,469,178

[45] Date of Patent: Sep. 4, 1984

[54] WELL GRAVEL PACKING METHOD

[76] Inventor: James R. Solum, 16842 Baruna La., Huntington Beach, Calif. 92646

[21] Appl. No.: 489,761

[22] Filed: Apr. 29, 1983

[51] Int. Cl.[3] ..... E21B 43/04

[52] U.S. Cl. ..... 166/278; 166/51; 166/178

[58] Field of Search ..... 166/278, 276, 51, 177, 166/178

[56] References Cited

U.S. PATENT DOCUMENTS

| | | | |
|---|---|---|---|
| 3,661,209 | 5/1972 | Solum | 166/278 |
| 3,834,471 | 9/1974 | Bottoms | 175/304 |
| 4,064,953 | 12/1977 | Collins | 175/321 |
| 4,418,754 | 12/1983 | Stepp | 166/278 |

*Primary Examiner*—Ernest R. Purser

*Assistant Examiner*—Timothy David Hovis

*Attorney, Agent, or Firm*—Lyon & Lyon

[57] ABSTRACT

A gravel packing method and apparatus for oil and gas wells having high angled portions, i.e. angled a substantial degree from the vertical, wherein slow rotation of the drill pipe is maintained throughout the pumping of the gravel ladened fluid to inhibit the accummulation of the gravel along the drill pipe in the high-angled portions. Each of several different embodiments of a selective rotation and releasing tool comprises tubular members that are relatively movable by vertical movement of the drill pipe to engage or disengage keys in keyways to selectively rotate or not rotate, respectively, a threaded releasing screw for releasing the liner at the completion of the gravel pack. The tool includes members for impacting one another upon rapid lowering of the drill pipe to jar the liner.

12 Claims, 12 Drawing Figures

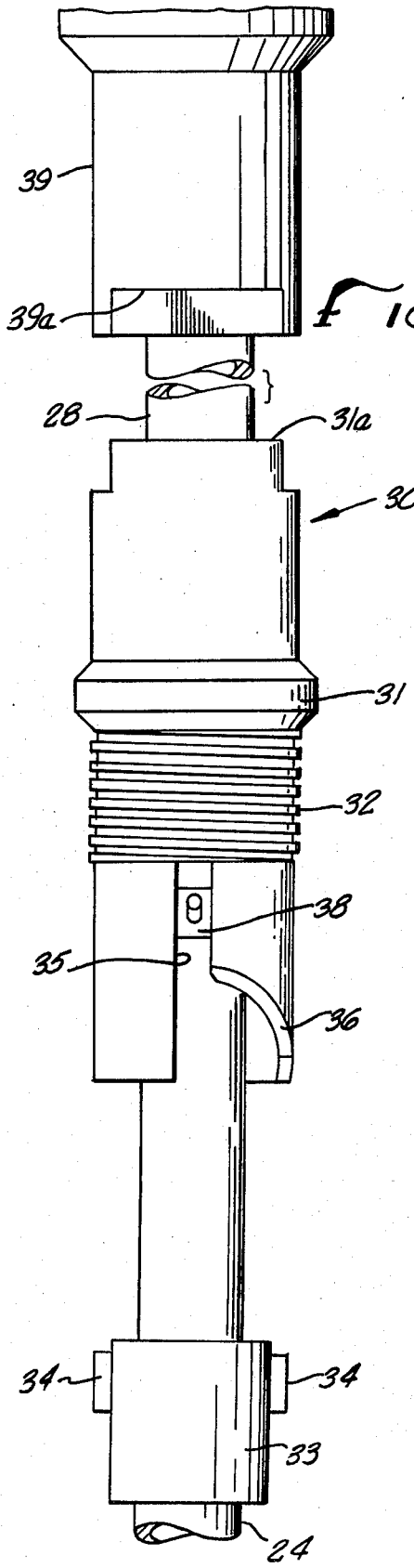
FIG. 4.
FIG. 12.
PRIOR ART
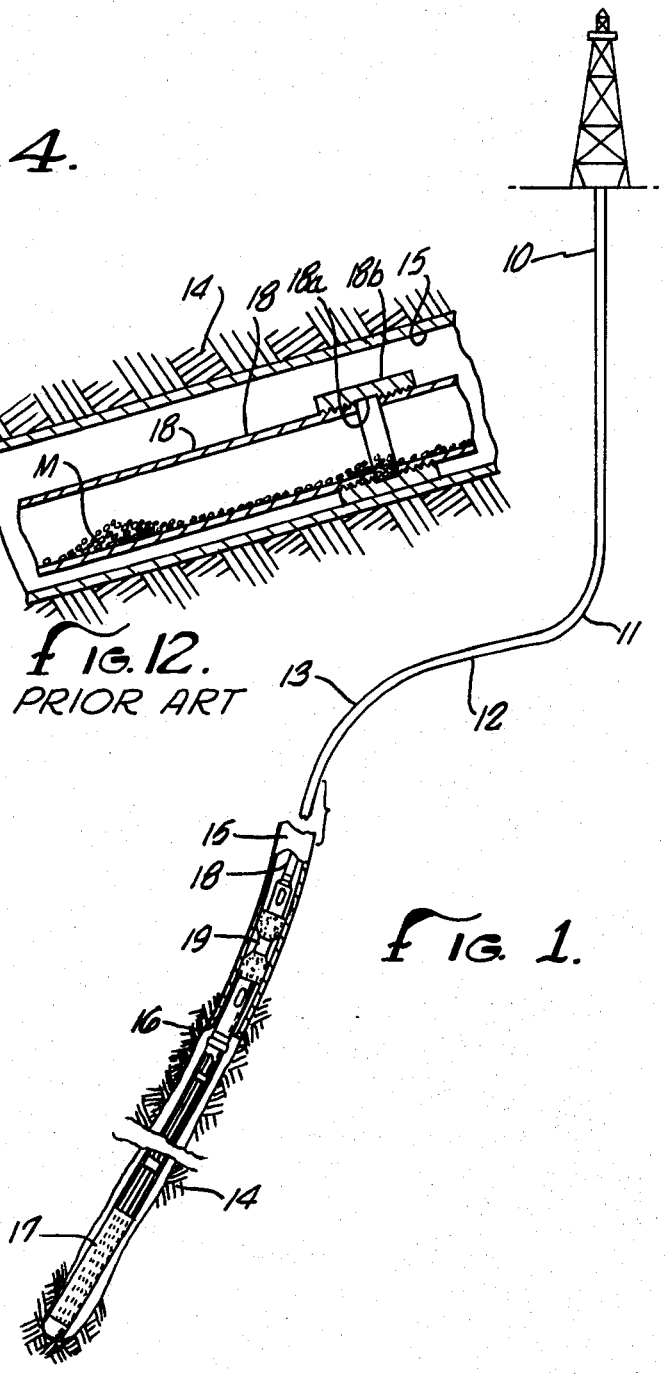
FIG. 1.

19
139
128
143
134
142
142
130
131
141
141
135
140
132
23

139
143
134
140
132
23

139
143
134
140
132
23

WELL GRAVEL PACKING METHOD

This invention relates to a method for gravel packing oil and gas wells and specifically for high-angled wells.

It has become increasingly common to gravel pack oil and gas wells to control certain problems encountered in various types of formations found in production zones. Normally a slotted liner is positioned in the open well bore at the production zone and the gravel, which is of a carefully selected size larger than the slots but of an appearance of coarse sand, is pumped with a fluid down through the drill pipe and outwardly into the annular space between the liner and the well bore. The volumetric capacity of the annulus is calculated using conventional logging techniques to measure the well bore and knowing the outside diameter of the slotted liner, and that calculated volume of gravel is pumped to fill the entire annular space. If the annulus is not completely filled, the gravel pack job is unsatisfactory for avoiding the problems of that production zone, such as sand incursion. Moreover, if the proper calculated amount of gravel is pumped down the drill pipe and into the annulus but the last portions of gravel are unable to enter the annulus due to bridging of the gravel or simply all the gravel not being pumped through the drill pipe, substantial problems are encountered as the drill pipe is released from the liner to come out of the well. The excess gravel above the top of the liner or in the drill pipe obviously does not form part of the gravel pack but rather falls into the liner and must be back-washed out of the well and other remedial steps must be taken in an attempt to complete the gravel pack.

Another problem that is encountered in gravel packing wells is the occurrence of a slug of gravel being pumped by the fluid rather than the gravel being carefully distributed throughout the fluid. When a slug of gravel with very little fluid reaches a restriction, such as the top of the liner, that gravel tends to bridge across the restriction causing an undesirable increase in pumping pressure and may even preclude further pumping or the passage of additional gravel. This problem of gravel slugs is normally prevented by proper feeding or dispersion of the gravel in the fluid as it is pumped from the surface and various methods and apparatus have been developed to accomplish that purpose, such as U.S. Pat. No. 3,428,219 having the same inventor as the present invention.

Also various methods and tools have been developed for attempting to insure a complete and homogenuous fill of gravel in the annular space between the slotted liner and the well bore by avoiding bridging or destroying gravel bridges that occur, and even promoting compaction of the gravel rather than merely loosely filling the annulus. U.S. Pat. Nos. 3,557,875; 3,661,209 and 3,770,054 having the same inventor as the present invention are examples of methods and apparatus that have been developed and used for assisting in the complete filling and compaction of the gravel in the annulus. Each of those patents discloses a method and apparatus for causing vibration of and impacting on the liner through the use of tools that are operated by rotation of the drill pipe. However, for such tools to be operated and the method to be productive, the drill pipe must be rotated rather rapidly, such as at least 50 rpm, which is not always possible.

For example, in wells drilled from offshore platforms or islands, or even onshore wells in populated areas drilled from a single site, it is necessary and has become extremely common to drill substantially vertically downward to an intermediate depth and then drill at a progressively increasing angle outwardly from the drill site to a location at or above the production zone and then to drill downwardly through the production zone. In some instances the outwardly drilled portion of the well may reach as high as 85° from the vertical (i.e. almost horizontal) and then be turned downwardly through the production zone to a more reasonable angle, perhaps 25° from vertical. Such wells are commonly referred to as "S" holes due to the profile created. Other wells are drilled with a portion at a substantial angle to the vertical that extends to the production zone without being straightened toward vertical. In either type of well, there is a "high-angled" portion and substantial curvature from the vertical which inhibits the use of otherwise common procedures since experience has shown that substantial trouble can be encountered by the use of such procedures. Specifically, drilling companies are reluctant to rotate the drill pipe during gravel packing or other well completion procedures beyond a few turns that are required to manipulate tools or release the pipe. More particularly, drilling companies are unwilling to rotate the drill pipe at a rapid rate for fear of twisting off the pipe or wearing out the casing with the drill pipe collars as has been their experience in high-angled and "S" holes. Thus, heretofore it has been impossible to use the vibrating methods and apparatus of the aforementioned patents in such holes since relatively rapid rotation is required. However, it has been found that gravel bridges and slugs easily form in these high-angled holes and cause many problems in gravel packing.

It is an object of this invention to provide a method for gravel packing high-angled well bores in which very slow rotation is used and yet most of the problems otherwise encountered in uniformly placing the gravel in the annulus are avoided.

It is a specific object of this invention to overcome problems of gravel packing a high-angled well bore wherein the gravel tends to accummulate in the drill pipe in the high-angled portions of the well bore during gravel packing by continually but very slowly rotating the drill pipe to thereby mechanically agitate and prevent such accummulation and the problems attendant thereto.

It is still a further object of this invention to provide apparatus for accomplishing the slow rotation of the drill pipe in high-angled wells throughout the gravel packing operation and yet accomplish convenient releasing of the liner by appropriate vertical movement of the drill pipe and righthanded rotation. A more detailed object is to provide such apparatus with which it is possible to cause jarring of the liner through rapid vertical movement of the drill pipe to cause an impacting of portions of the apparatus at or above the top of the slotter liner.

Other and more detailed objects and advantages of this invention will appear from the following detailed description and the accompanying drawings wherein:

Fig. 1 is a diagrammatic illustration of a typical slant drilled well of the "S" type having a very high-angled portion and illustrating one form of the method and apparatus of this invention.

FIG. 4 is an enlarged view of the form of rotating and liner releasing tool illustrated in FIGS. 2 and 3.

FIG. 12 is an enlarged diagrammatic view of a high-angle portion of a well bore illustrating some of the problems with the prior art methods.

Figure 2:
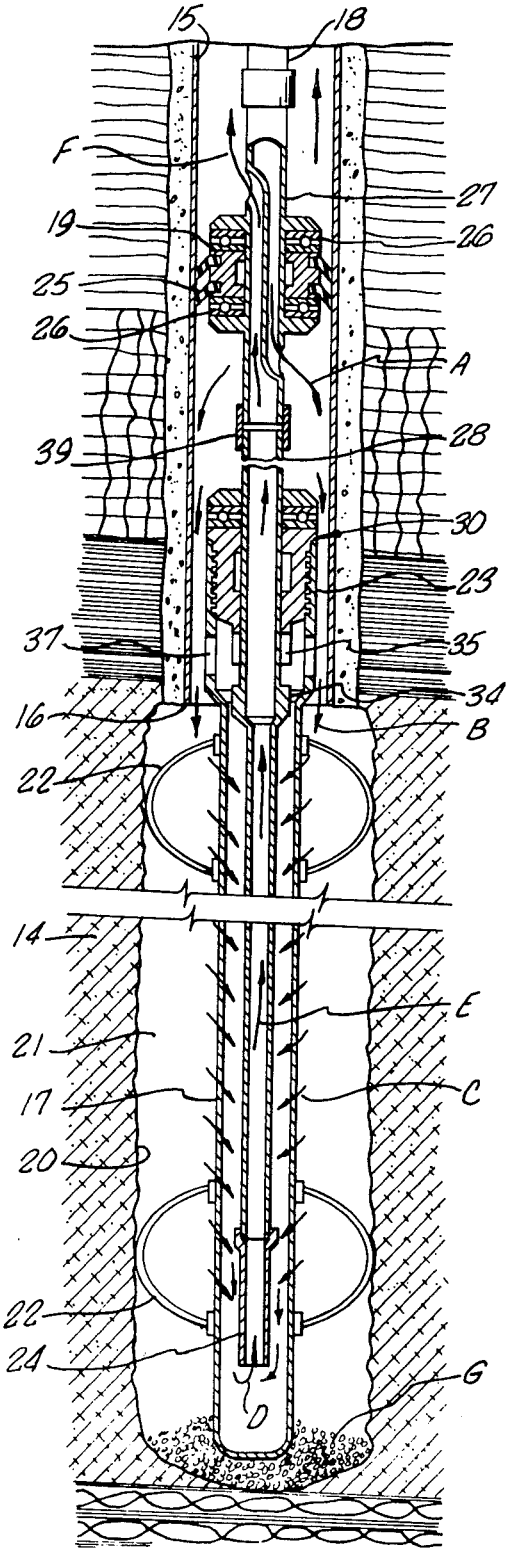
FIG. 2 is an enlarged diagrammatic illustration of one form of the apparatus of this invention being used during that portion of the method of this invention wherein the gravel is being pumped to and placed in the annular space surrounding the slotted liner.

Referring now to FIG. 1, a typical slant drilled well bore 10 of the "S" type is illustrated wherein a first curved section 11 leads to a high-angled portion 12 which in turn leads to a further curved section 13 tending to return the well bore to a vertical orientation for passing through the production zone 14 of the well. It is not unusual for the high-angled portion 12 of the well bore to reach an angle of 85° from the vertical, and it is very common to exceed 40° which drilling companies consider to be approximately the maximum angle at which they will allow rapid rotation of the drill pipe during gravel packing or other procedures as described above. The downwardly curved portion 13 of the well bore may be immediately above or even a couple of thousand feet above the production zone 14, depending on the particular conditions of the well. A well casing 15 is centered in the well bore and may terminate at 16 at the top of the production zone. FIG. 1 illustrates the slotted liner or wire wrapped liner 17, herein referred to as a "perforate liner," positioned in the bottom of the well at the production zone 14 after having been lowered thereto by the drill pipe 18 with the crossover tool 19, all ready for the start of gravel packing.

Referring more particularly to FIG. 2, the liner 17 is shown positioned in the open well bore 20 at the production zone 14 and preferably centered in the annular space or annulus 21 by centralizers 22 for creating a relatively uniform annulus 21 for receiving the gravel. The arrows illustrate the direction of fluid flow during the pumping of the gravel into the annulus, namely, downwardly through the drill pipe to and through the divided passages of the crossover tool 19 as shown by arrow "A" and then downwardly past the liner top 23 into the annulus as shown by arrow "B". The fluid flows through the slots in the liner 17 as shown by arrows "C" to the open bottom end of a tail pipe 24 as shown by arrow "D". The gravel "G" is deposited in the annulus 21 and the fluid returns upwardly through tailpipe 24 as shown by arrow "E" past the liner top, through the crossover tool and into the annulus as shown by Arrow "F". The procedure as thus far described is relatively conventional and normally continues until the gravel "G" fills the annulus 21 to or above the bottom end 16 of the casing 15 or at least sufficiently high to cover all of the slots in the liner 17.

Figure 3:
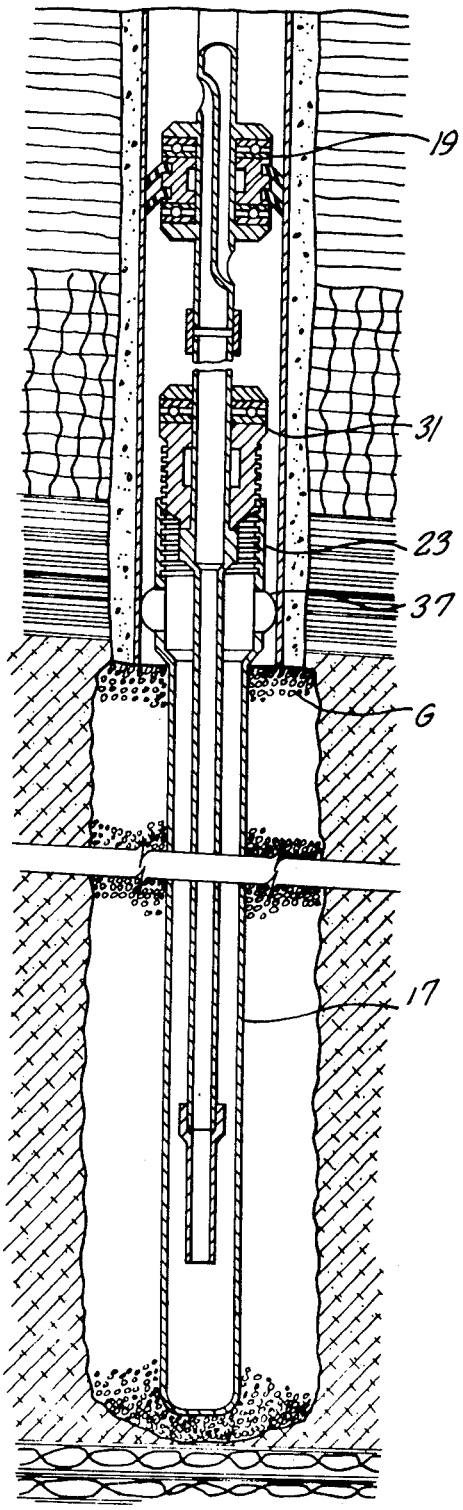
FIG. 3 is an enlarged diagrammatic illustration similar to FIG. 2 but illustrating the final portion of the method of this invention following completion of the gravel pack.

The crossover tool 19 is of the type having resilient sealing cups 25 for engaging the casing 25 to prevent fluid flow there past and bearings 26 supporting those cups on the crossover tool to allow rotation of the central mandrel 27 of the crossover tool without rotating the cups which engage the interior of the casing and would result in destruction of the cups if continually rotated. The lower end of mandrel 27 of crossover tool 25 is connected to a tubing member 28 of a selective rotation and liner releasing tool, generally designated 30, as more fully illustrated in FIG. 4. The tool 30 includes a tubular body 31 having left-handed Acme or square threads 32 for threadedly engaging the liner top 23. The tubing member 28 is slidably and rotatably received in the tubular body 31 and has a collar portion 33 at its lower end for connecting to the tail pipe 24. A pair of keys 34 are provided on collar 33 for engaging a pair of slots 35 in the lower end of tubular body 31 with inclined portions 36 to guide the keys 34 into the slots 35. With the tubing member 28 and tubular body 31 in the relative positions shown in both FIGS. 2 and 4 the tubing member 28 is free to be rotated relative to tubular body 31. However, by raising tubing member 28 to engage keys 34 in slots 35 the tubing member 28 may be rotated (by the crossover tool mandrel 27 and drill pipe) in a righthanded direction to unthread the tubular body 31 from the liner top 23, which unthreaded condition is illustrated in FIG. 3.

The liner top 23 may include a liner hanger of any conventional type for hanging the liner 17 from the casing 15. The liner top 23 will include a packer element 37 which, as shown in FIG. 3, is expanded into engagement with the inside of casing 15 to seal off the top of the gravel pack in a conventional manner.

It should be noted that in the assembled condition of the tool 30 and liner top 23 a spring loaded key 38 mounted on tubular body 31 to slide vertically is adapted to engage a mating slot on the inside of the liner top 23 to prevent inadvertent rotation between the liner top 23 and tool 30 which might result in premature releasing. The spring loaded keys 38 are actuated to a released condition by the keys 34 when it is desired to rotate the tool 30 and release the liner as described above.

With the apparatus as described above, the method of this invention is performed in the following manner. The slotted liner 17 is assembled and run into the bore 10 with centralizers 22 in place. The liner top 23 with liner releasing tools 30 assembled therewith is connected to the top of the liner. The crossover tool 19 is connected to the top of tool 30 and the drill pipe 18 is connected to the top of the crossover tool whereby the liner 17 is run to the bottom of the well bore in the conventional manner. Circulation of a fluid is established and the usual procedures for cleaning and conditioning the well bore in preparation for the gravel packing may be accomplished. The fluid in the well may be changed over from the conventional drilling fluid to a lighter fluid such as water or foam for use in the gravel packing and once the full circulation of that fluid has been established the well is ready for gravel packing. Normally 2 to 5 cubic feet of gravel are pumped down into the annulus to fill the bottom of the hole and then the liner 17 is lowered onto that gravel or a liner hanger (not shown) may be used to hang the liner above the bottom of the hole. Next the drill pipe 18 is lowered to a position where the keys 34 on the tool 30 are well below the key ways 35 to allow rotation of the drill pipe without causing release of the liner top. By this invention, the drill pipe 18 is rotated at a very slow rate, preferably between approximately 1 rpm and 10 rpm which has been found to be acceptable to the drilling companies and operators as not causing a risk of twisting off the drill pipe and yet accomplishing the purposes of this invention. This slow rotation is continued while the gravel dispersed in the fluid is pumped down the drill pipe, through the crossover tool 19 over the top of the liner and into the annulus where the gravel "G" is deposited in the manner described above. By this continuous rotation of the drill pipe 18 during pumping of the gravel the gravel is continually agitated an mixed with the fluid throughout the length of the drill pipe including particularly in the high-angled portion 12, preventing the gravel from accummulating in the "J" slot 18*a* formed at the coupling 186 between joints of drill pipe and "mounding" (as at "M") of the gravel along the length of the pipe which has been found to occur in prior experience and tests without rotation as shown in FIG. 12. This continuous slow rotation maintains the gravel dispersed in the fluid to prevent slugs of gravel forming that might otherwise become bridged in the crossover tool 19 or in the restricted space between the liner top 23 and the inside of the casing 15 or in the annulus 21. In this manner the entire calculated volume of gravel will be placed in the annulus 21 during the pumping of the gravel and the continued slow rotation whereby the normal, predictable pressure build-up will be observable at the surface when the last of the gravel fills the annulus and covers the last of the slots in the liner 17. When the last of the gravel has passed the crossover tool the rotation of the drill pipe is stopped and the drill pipe is lifted slowly to cause the keys 34 to engage the keyway 35 in the tool 30 whereupon additional righthand rotation of the drill pipe causes unthreading of the threads 32 on tubular body 31 from the liner top 23 as shown in FIG. 3. The packer element 37 is then set to seal the top of the gravel pack and the drill pipe, crossover tool 19, selective rotation and releasing tool 30, and tail pipe 24 may be removed from the well to complete the gravel packing procedure.

As an alternative, a jam-on packer may be installed on the top of the liner after removal of the gravel packing tools.

In the event that any premature pressure build-up is noticed while still pumping the gravel ladened fluid downwardly in the drill pipe and rotating the drill pipe which would indicate a bridging of the gravel somewhere in the system, the apparatus of this invention may be used to "jar" the components which has been found successful in relieving the bridging to eliminate the premature pressure build-up. Jarring is accomplished by temporarily stopping rotation of the fluid pipe 18 while continuing fluid pumping if the pressure buildup is not too excessive and rapidly lowering the drill pipe to cause the collar 39 at the top of the tubing number 28 of the tool 30 to impact against the top of the tubular body 31. This raising and rapid lowering may be repeated until a pressure drop is observed. It is believed that this procedure is particularly effective in that the most susceptible location for gravel bridging in the system is at the liner top 30 which is closely spaced from the inside of the casing 15 and may include slips for the hanger which present further obstructions. Also, the crossover tool 19 immediately there above is jarred by this impact to loosen any bridging that may occur in the reduced size fluid passages therethrough. Upon the fluid pressure returning to the normal desired level, the drill pipe may be lifted to an intermediate position and slow rotation re-established to inhibit further gravel bridging. The collar 39 is also provided with recessed portions 39*a* on the lower end adapted to engage upward projections 31*a* on the body 31 under emergency conditions to cause right-hand rotation of body 31 for forceably releasing same.

Another desirable feature of the apparatus and method of this invention is that by providing a relatively long tubing member 28 in the selective rotation and releasing tool 30 the drill pipe can be moved vertically to various positions throughout the gravel packing while continuing the slow rotation to avoid any possibility of the drill pipe tool joints or collars from imparting excessive wear to a single location on the inside of the casing 15. It is considered very poor well rig practice to rotate drill pipe within a casing at precisely the same location for excessive periods of time which has been known to cause excessive spot wearing of the casing, particularly in high-angled holes where it is obvious that the full weight of the drill pipe is resting on the casing and the tool joints or collars have the potential of causing serious wear and damage.

Figures 5, 6, 7:
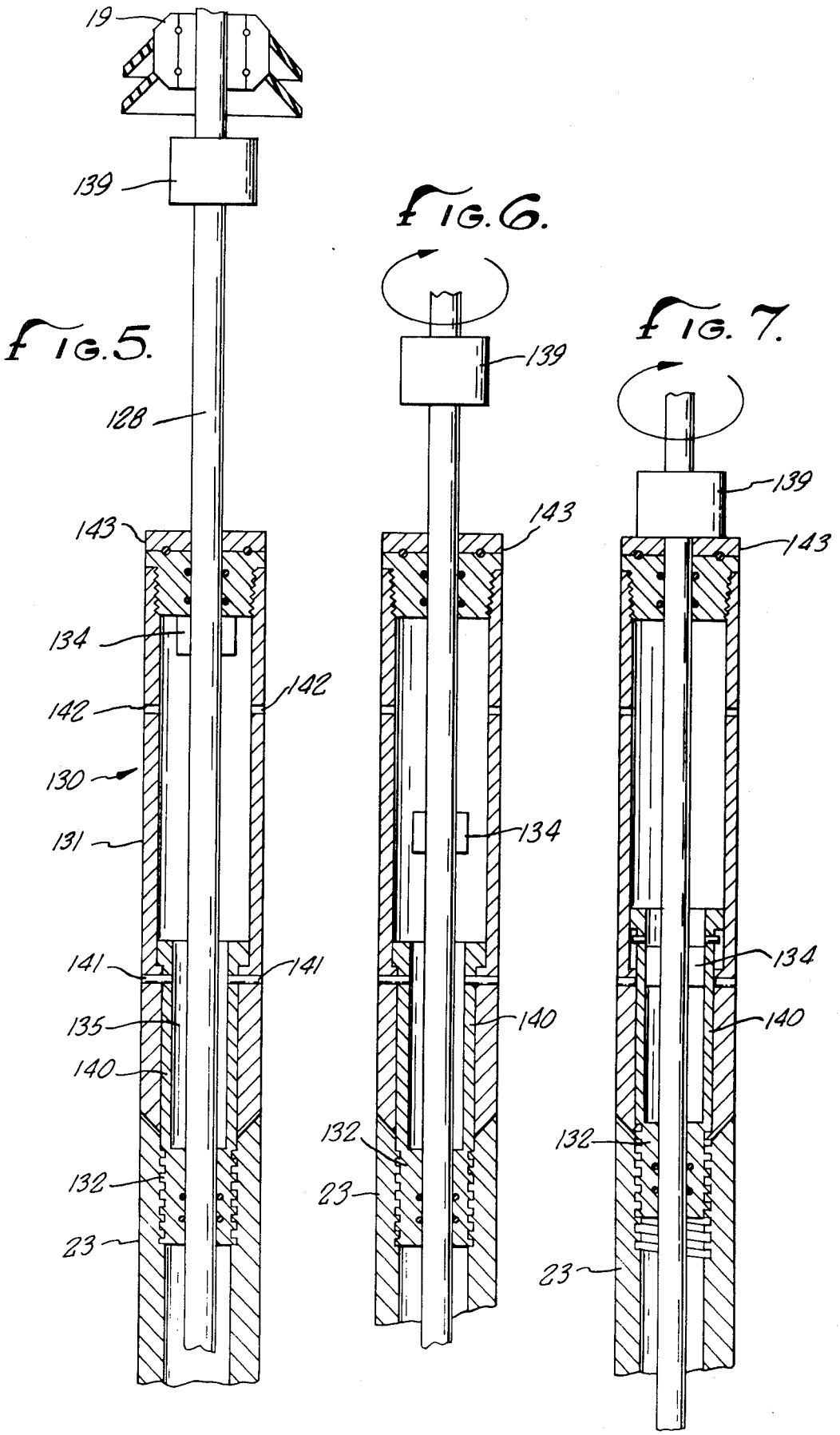
FIG. 5 is an elevation view with portions shown in section of another form of rotating and liner releasing tool positioned for running the liner into the wall.
FIG. 6 is an elevation view of the device of FIG. 5 with the components in the position for rotation of the drill pipe without rotating the liner.
FIG. 7 is another view of the device of FIGS. 5 and 6 with the components in the position during the releasing of the linear.

Referring now to FIGS. 5, 6 and 7, a second embodiment of the selective rotation and releasing tool, generally designated 130 is illustrated in which like components are given like numbers in the 100 series, to the extent their function is the same as the previously described embodiment. Tool 130 is provided with a tubing member 128 having an upper collar 139 for joining to the crossover tool 19 as previously described. Tubing member 128 passes through a tubular body 131 in sliding and rotatable relationship. A tubular releasing screw 140 is mounted in the lower end of tubular body 131 and has a pair of keyways 135 therein adapted to be engaged by keys 134 on the tubular member 128. The tubular screw 140 is provided with lefthanded Acme or square threads 132 at its lower end which are threadedly engaged with the liner top 23 for running of the liner into the hole and the gravel packing. The tubular screw 140 is joined to the tubular body 131 by shear pins 141 to prevent inadvertent unthreading of tubular screw 140 from the liner top and inadvertent releasing thereof. Also tubular body 131 may be provided with vents 142 to prevent a pressure differential between the inside and outside of the tool that would effect operation.

The selective rotation and releasing tool 130 of FIGS. 5, 6 and 7 is used in the method of this invention in substantially the same manner described above. While running the liner into the well bore as shown in FIG. 5 the liner is supported from the keys 134 by engaging the top of the tubular body 131. When the liner is in the appropriate position and gravel packing is ready to begin the drill pipe is lowered a short distance to position the keys 134 in the extended open area or cavity of tubular body 131 whereby righthand rotation of the drill pipe does not effect the tubular body 131 or tubular screw 140, particularly in view of the shear pins 141 preventing releasing even though frictional forces between tubing member 128 and screw 140 might tend to cause unthreading from the liner top 23. In the event an unexpected pressure buildup occurs, some jarring can be effected with this tool by stopping rotation and rapidly lowering the drill pipe to impact the collar 139 on top of the tubular body 131 or keys 134 on top of the tubular screw 140, depending on whether the keys engage or miss the key ways. When the gravel packing has been completed, the drill pipe is lowered to cause the collar 139 to engage the top of the tubular body 131, which preferably has a rotatable bearing member 143 whereby the keys 134 are engaged in the keyways 135 and righthand rotation will cause the pins 141 to be sheared and unthreading of the tubular screw 140 from the liner top 23 much in the same manner as described with respect to the first embodiment. One advantage of the tool 130 of the embodiment of FIGS. 5, 6 and 7 is that the weight of the drill pipe can be lowered onto the tool for accomplishing releasing which is a very conventional procedure known to and accepted by drillers whereas in the first embodiment the drill pipe must be lifted to the proper height and preferably without placing a strain on the drill pipe during unthreading since this can cause damage to the releasing tool threads 32.

Figure 8:
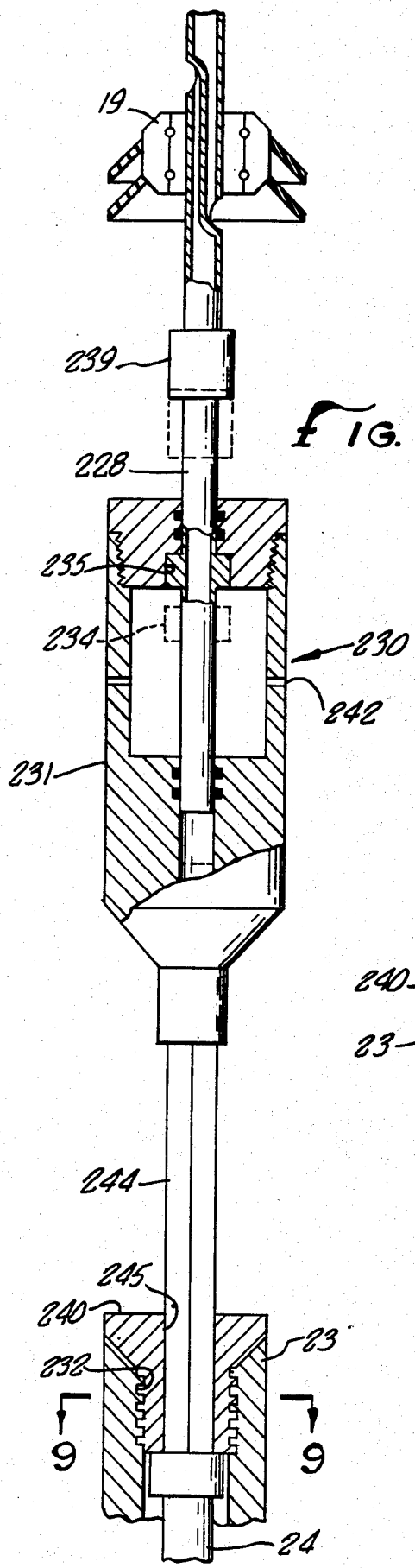
FIG. 8 is an elevation view with portions in section of another embodiment of the selective rotation and liner releasing tool of this invention with the components shown for lowering the liner into the well and further shown in phantom lines for rotation of the drill pipe.
Figure 9:
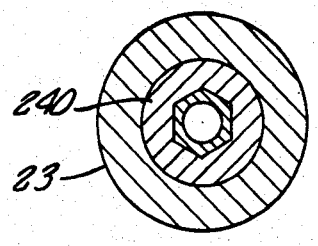
FIG. 9 is a sectional plan view taken substantially on the line 9—9 in FIG. 8.

Referring now to the embodiment of FIGS. 8 and 9, the selective rotation and releasing tool, generally designated 230 is similar to the previous embodiments and like numbers in the 200 series will be used to identify like components. Again, a tubing member 228 is connected to a collar 239 and to the crossover tool 19 supported from the drill pipe. The tubing member 228 is slidably and rotatably received in the tubular body 231 and has keys 234 adapted to mate with keyways 235 in the upper portion of the tubular body 231. The lower end of tubular body 231 has a non-circular mandrel 244 adapted to pass through a mating non-circular hole 245 in a tubular screw 240 having lefthand threads 232 for releasable connection to the liner top 23. As shown in FIG. 9 the non-circular cross-section of mandrel 244 and hole 245 is hexagonal but any other shape may be used such as the alternative shown in FIG. 10 with keys and keyways. This mandrel 244 allows the tubular screw 240 to move up the mandrel unrestrained during unthreading. Again, the tubular body 231 may be provided with vents 242 for pressure equalization.

Figure 10:
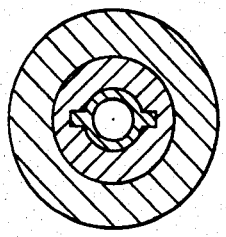
FIG. 10 is a sectional plan view similar to FIG. 9 but illustrating an alternate configuration.

The apparatus of FIGS. 8, 9 and 10 is used in the same manner as described with respect to the previous embodiments in performing the method of this invention. To accomplish releasing of the liner the drill pipe is raised to engage the keys 234 in keyways 235. Jarring is possible by rapidly lowering the drill pipe to engage the collar 239 on the top of the tubular body 231 and in turn engaging the top of the tubular screw 240. During rotation of the drill pipe while gravel packing, the keys 234 are lowered to the position shown in dashed lines and no rotation of the tubular body 231 or mandrel 244 or the tail pipe 24 is caused.

Figure 11:
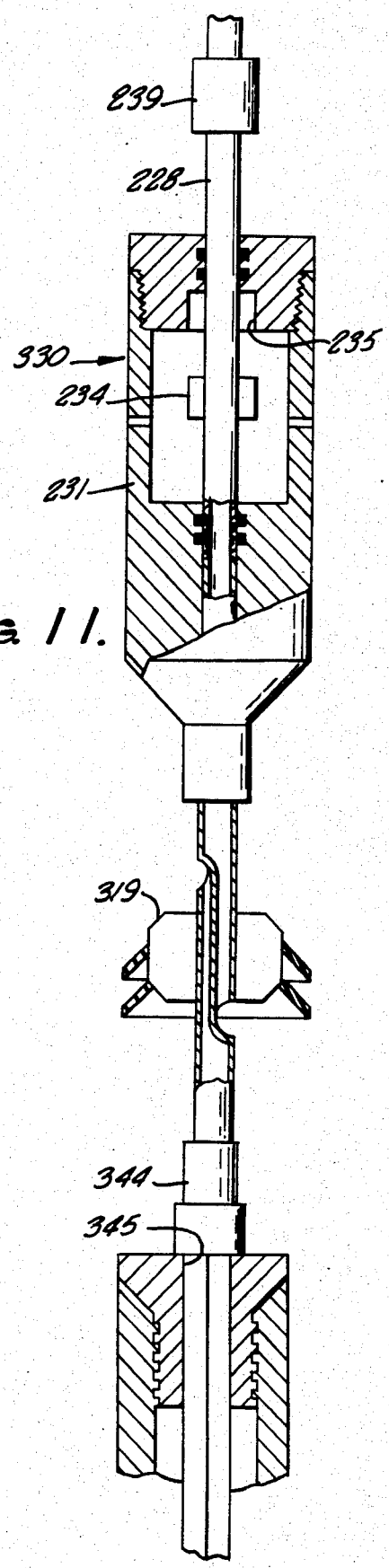
FIG. 11 is an elevation view with portions in section of still another embodiment of the selective rotation and liner releasing tool of this invention and illustrated in the position for allowing rotation of the drill pipe without imparting rotation to the liner.

Referring now to FIG. 11, the embodiment of the selective rotating and releasing tool, generally designated 330, will be described with like numerals in the 300 series for like components in the previously-described embodiments. Again, a tubing member 228 has an upper collar 239 and is slidably and rotatably mounted in a tubular body 231. Keys 234 are adapted to engage keyways 235 for selective releasing of the liner identical to the embodiment of FIG. 8. However, one substantial difference in this embodiment of FIG. 11 is that the crossover tool 319 is mounted between the tubular member 231 and the liner whereby the crossover tool will not rotate during the slow rotation for the gravel packing. This permits the use of a greatly simplified crossover tool without the bearings 26 of the first embodiment rotatably supporting the cups 25. Moreover, if desired the tool 330 may be positioned a great distance above the crossover tool and just below the high-angled portion of the well for rotating even less drill pipe. The crossover tool 319 serves to connect the tubular body 231 to a non-circular mandrel 344 passing through a non-circular hole 345 in a tubular screw 340 having lefthand threads 332 connected to the liner top 23. As with the embodiment of FIG. 8, the tailpipe is not rotated in the emodiment of FIG. 11 and jarring is possible through the rapid lowering of the drill pipe.

Thus it may be seen that with each of the above-described embodiments of the apparatus, the method of this invention may be practiced to slowly rotate the drill pipe throughout the pumping of the gravel until the completion of the gravel pack to prevent accummulation of the gravel in the drill pipe and to enhance the distribution of gravel in the pumping fluid at all times. Further, jarring of the top of the liner may be accomplished in the unlikely event that a premature pressure buildup occurs indicating a bridging of gravel. Further, each embodiment allows some change in vertical position of the drill pipe with respect to the casing during the gravel packing to avoid spot wearing of the casing by the drill pipe tool joints.

Although I have described the method and apparatus of my invention in connection with specific embdiments of the components, it is to be understood that my invention is not limited to the details herein set forth but rather is of the full scope of the appended claims.

I claim:

1. In a method for gravel packing wells having at least some high-angled portions of well bore in which a perforate liner is to be positioned in the well at the production zone to be gravel packed wherein a releasing tool is connected to the top of the liner, a crossover tool is provided above the liner, a drill pipe is provided for lowering the liner and tools into the well, and means are provided for selectively allowing rotation of at least that portion of the drill pipe to be positioned in the high-angled portion of the well bore without rotating the liner, the method comprising: lowering the assembled liner, releasing tool, crossover tool and selective rotation means into the well with the drill pipe to position the liner in the production zone and the selective rotation means below at least a significant portion of the high-angled portions of the well bore, manipulating the drill pipe to allow rotation of the drill pipe relative to liner through the selective rotation means, pumping fluid with gravel dispersed therein down the drill pipe and out through the crossover tool into the annulus around the outside of the liner, slowly rotating the drill pipe without rotating the liner throughout substantially the entire duration of said pumping of the gravel-laden fluid through the crossover tool, terminating said pumping after all the gravel has passed the crossover tool, manipulating the drill pipe to operate the releasing tool to release the liner from the releasing tool, and removing the drill pipe, releasing tool, crossover tool and selective rotation means from the well bore.

2. The method of claim 1 wherein the drill pipe is also moved vertically at least once during said slow rotation to change the position of the drill pipe in the well.

3. The method of claim 1 wherein the drill pipe is reciprocated slowly during at least a portion of said slow rotation.

4. The method of claim 1 wherein said slow rotation is maintained at or below substantially ten rpm.

5. The method of claim 1 wherein said slow rotation is maintained between approximately one rpm and 10 rpm for a substantial proportion of said rotation.

6. The method of claim 1 wherein said drill pipe is raised a predetermined distance without lifting said liner and rapidly lowered to cause a jarring impact on the top of the liner to tend to eliminate any bridging of gravel in the annulus.

7. The method of claim 6 wherein said raising and rapid lowering of the drill pipe for impact jarring is performed in response to unexpected pressure increases while pumping.

8. In an improved method for gravel packing a perforate liner in the production zone of wells having at least some high-angled portions of well bore through which the drill pipe passes for lowering the perforate liner into the production zone and in which the gravel-ladened fluid is pumped down the drill pipe and out through the crossover tool into the annulus around the outside of the liner, the improved method comprising, slowly rotating the drill pipe without rotating the liner throughout substantially the entire duration of said pumping the gravel-laden fluid through the crossover tool.

9. The improved method of claim 8 wherein the drill pipe is moved vertically during said slow rotation.

10. The improved method of claim 8 wherein the drill pipe is moved rapidly downward to jar the liner upon the occurrence of an unexpected increase in fluid pumping pressure.

11. The improved method of claim 8 wherein said slow rotation is maintained between substantially one rpm and ten rpm.

12. The improved method of claim 8 wherein a tail pipe is provided in the liner, and the step of rotating the drill pipe without rotating the tail pipe.

* * * * *

UNITED STATES PATENT AND TRADEMARK OFFICE

CERTIFICATE OF CORRECTION

PATENT NO. : 4,469,178

DATED : September 4, 1984

INVENTOR(S) : James R. Solum

It is certified that error appears in the above—identified patent and that said Letters Patent is hereby corrected as shown below:

Column 3, line 17 change "linear" to --liner--.

Column 5, line 24 change "an" to --and--.

Column 8, line 17 change "emodiment" to --embodiment--.

Column 8, line 35 change "embdiments" to --embodiments--.

Signed and Sealed this

*Twenty-sixth* Day of *March 1985*

[SEAL]

*Attest:*

DONALD J. QUIGG

*Attesting Officer* *Acting Commissioner of Patents and Trademarks*